US006039092A

United States Patent [19]

Muscara

[11] Patent Number: 6,039,092

[45] Date of Patent: Mar. 21, 2000

[54] CONVEYOR DRIVE AND CONTROL SYSTEM

[76] Inventor: Dominic Muscara, 68 Coakley St., Islen, N.J. 08830

[21] Appl. No.: 09/253,093

[22] Filed: Feb. 22, 1999

[51] Int. Cl.[7] ..... B65B 43/42

[52] U.S. Cl. ..... 141/129; 141/155; 141/156; 141/160; 198/832.1; 198/750.5; 198/750.6; 198/750.7

[58] Field of Search ..... 141/129, 155, 141/156, 160; 198/832.1, 768, 750.7, 750.6, 750.5

[56] References Cited

U.S. PATENT DOCUMENTS

| | | | |
|---|---|---|---|
| 3,437,191 | 4/1969 | Auernhammer et al. | 198/832.1 |
| 3,834,521 | 9/1974 | Rauch et al. | 198/203 |
| 4,189,279 | 2/1980 | Anderson | 198/832.1 |
| 5,419,099 | 5/1995 | Mueller et al. | 141/160 |

*Primary Examiner*—Steven O. Douglas
*Assistant Examiner*—Khoa Huynh
*Attorney, Agent, or Firm*—William E. Mouzavires Esq.

[57] ABSTRACT

Method and apparatus for conveying a plurality of containers to a filling station for supplying the containers with paints or coatings. The conveyor is periodically driven to the filling station by a rotary actuator including a plurality of air motors which drive a pinion which in turn is connected to the drive shaft of the conveyor for moving the conveyor in one direction to the filling station. The conveyor drive shaft operates a cam which controls a valve in an air supply line for actuating a diverter valve which controls the supply of air to the rotary actuator. The conveyor is stopped when the cam closes the valve, this occurring when the containers reach the filling station. After the containers are filled, a solenoid is actuated through a timer to open a second air supply valve in a second air supply line which is used to actuate the diverter valve to drive the rotary actuator a distance sufficient to move the cam for opening the first supply line whereupon the conveyer continues to be driven to remove the filled containers from the processing station and to bring new containers to be filled to the processing station. The valve controlling the second air supply line is closed through a timing mechanism which in turn is controlled by a computer-controlled signal occurring when the containers are filled.

15 Claims, 6 Drawing Sheets

CONVEYOR DRIVE AND CONTROL SYSTEM

OBJECTS OF THE PRESENT INVENTION

The present invention generally relates to conveyor systems and more particularly to drive and control systems for conveyors. Although the present invention is particularly suitable for conveyors that are periodically driven or indexed to a processing station, it should have applicability in other environments or processing systems. The present invention also relates to novel methods and apparatus for conveying and filling containers with substances such as paints and coatings.

An object of the present invention is to provide a novel and improved conveyor system including a drive and control system for operating a conveyer. Included herein is such a system that is suitable for periodically driving a conveyer to one or more processing stations.

A further object of the present invention is to provide a novel and improved drive and control system for periodically driving or indexing a conveyor.

Another object of the present invention is to provide a novel and improved drive system for a conveyor which system utilizes a rotary actuator for driving the conveyor.

A further object of the present intention is to provide novel and improved method and apparatus for conveying containers to a filling station and for filling the containers with substances such as paints or coatings.

SUMMARY OF PREFERRED EMBODIMENT OF THE INVENTION

Containers are carried by a conveyor which is indexed to a filling station by a rotary actuator including an air motor having a rack driving a pinion which in turn is connected to the drive shaft of the conveyor by a clutch mechanism which allows the drive shaft and in turn the conveyor to be driven in one direction only. A cam driven by the conveyor drive shaft controls a valve in a first air supply line for actuating a diverter valve which controls the supply of air to the air motor. A second air supply line to the diverter valve is provided for initiating movement of the conveyer at the beginning of a cycle at least until the cam opens the air valve the first air supply line. Flow of air in the second air supply line is controlled by a valve operated by a timer mechanism which in turn is operated by a signal when the container has been filled and it is necessary to advance the conveyor to bring a new empty container to the station while removing the filled container from the station.

DRAWINGS

Other objects and advantages of the present invention will become apparent from the following, more detailed description of the invention taken in conjunction with the attached drawings in which.

DETAILED DESCRIPTION

Figure 1:
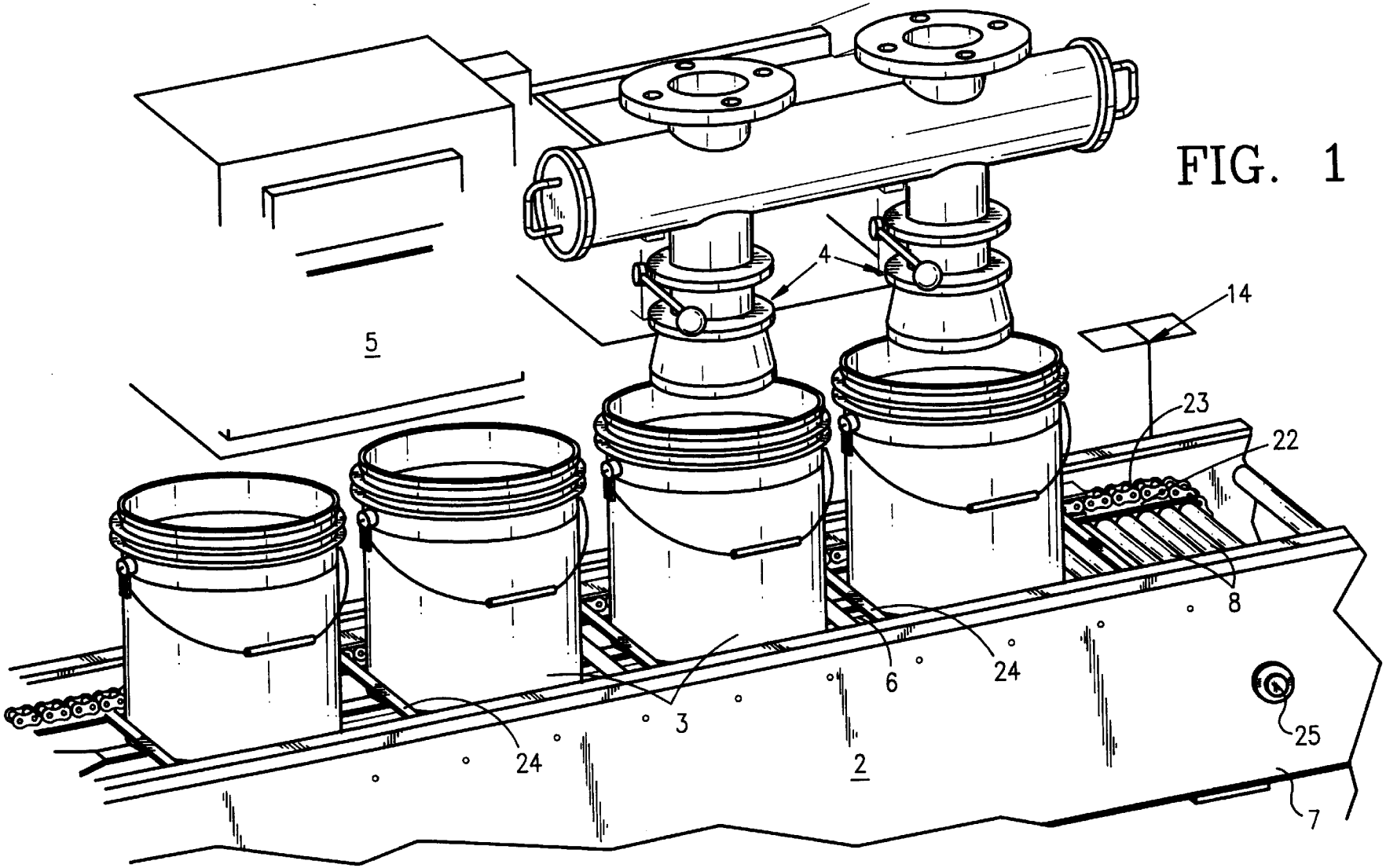
FIG. 1 is a perspective view of a conveyer and filling system incorporating a preferred embodiment of the present invention.

Referring now to the drawings in detail and initially to FIG. 1, there is shown for illustrative purposes only apparatus constituting a preferred embodiment of the invention and including a conveyor generally designated 2 which is moved or indexed periodically for example to convey objects to and away from a processing station. Although in the particular embodiment shown, the objects are containers 3 which are moved to a filling station for receiving paints or coatings, it will become apparent that the present invention may be utilized in other environments and for other purposes. In the specific embodiment shown and to be described below, the containers may be five gallon containers which are to be filled with paint at a filling station where one or more filling valves and nozzles generally designated 4 are located above conveyor 2 to overlie the containers as shown in FIG. 1. The amount of paint to be introduced in the containers is controlled by one or more computers generally designated 5 which control fill valves above the nozzles such that when the predetermined desired weight of the paint introduced into the container is reached and determined by a scale generally designated 6, the computer will send a signal closing the fill valves. In one preferred embodiment when fifty percent of the target weight of the paint to be introduced in the container is reached as indicated by the scales 6, the fill valves close and the computer determines the difference between the actual weight introduced in the container and fifty percent of the target weight. The computer then reopens the fill valves for the final fill to the target weight while making adjustments based on the difference between the actual and target weights previously learned. When the target weight is reached the scale will send a signal and the computer will close the fill valves. If the actual weight introduced in the container is below the target weight including certain tolerances, the computer will automatically "jog" into the container additional small amounts of paint until the target weight is reached with tolerances. If on the other hand the actual weight introduced into the container is above the target weight, the computer will make adjustments in the following filling operation. Thus the computer continues to track each filling operation and make adjustments in the next filling operation to compensate for variations in the actual weight of the paint introduced from the target weight in the previous fill operation.

Figure 2:
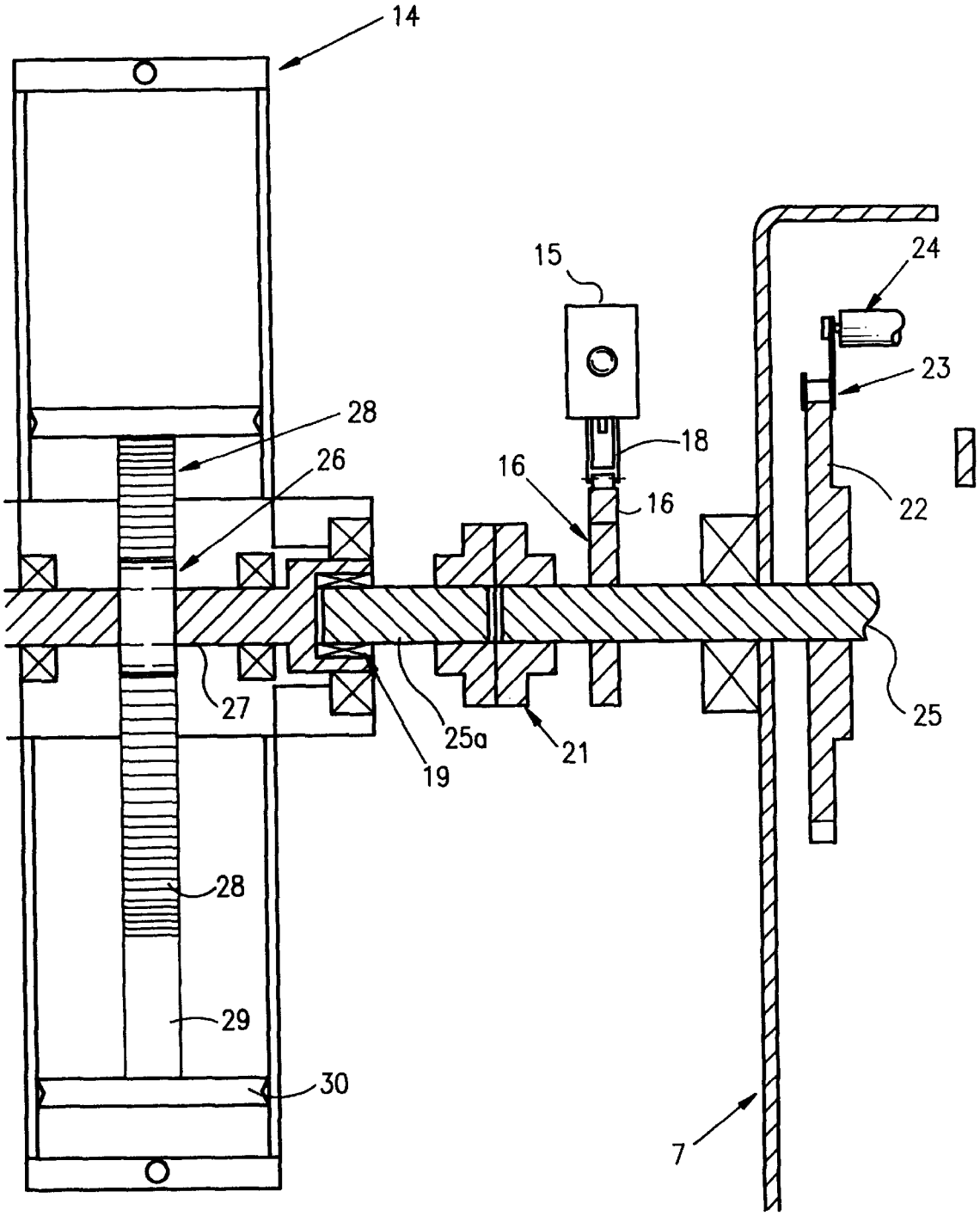
FIG. 2 is a cross sectional view along a portion of the drive shaft of the conveyer included in the system.
Figure 3:
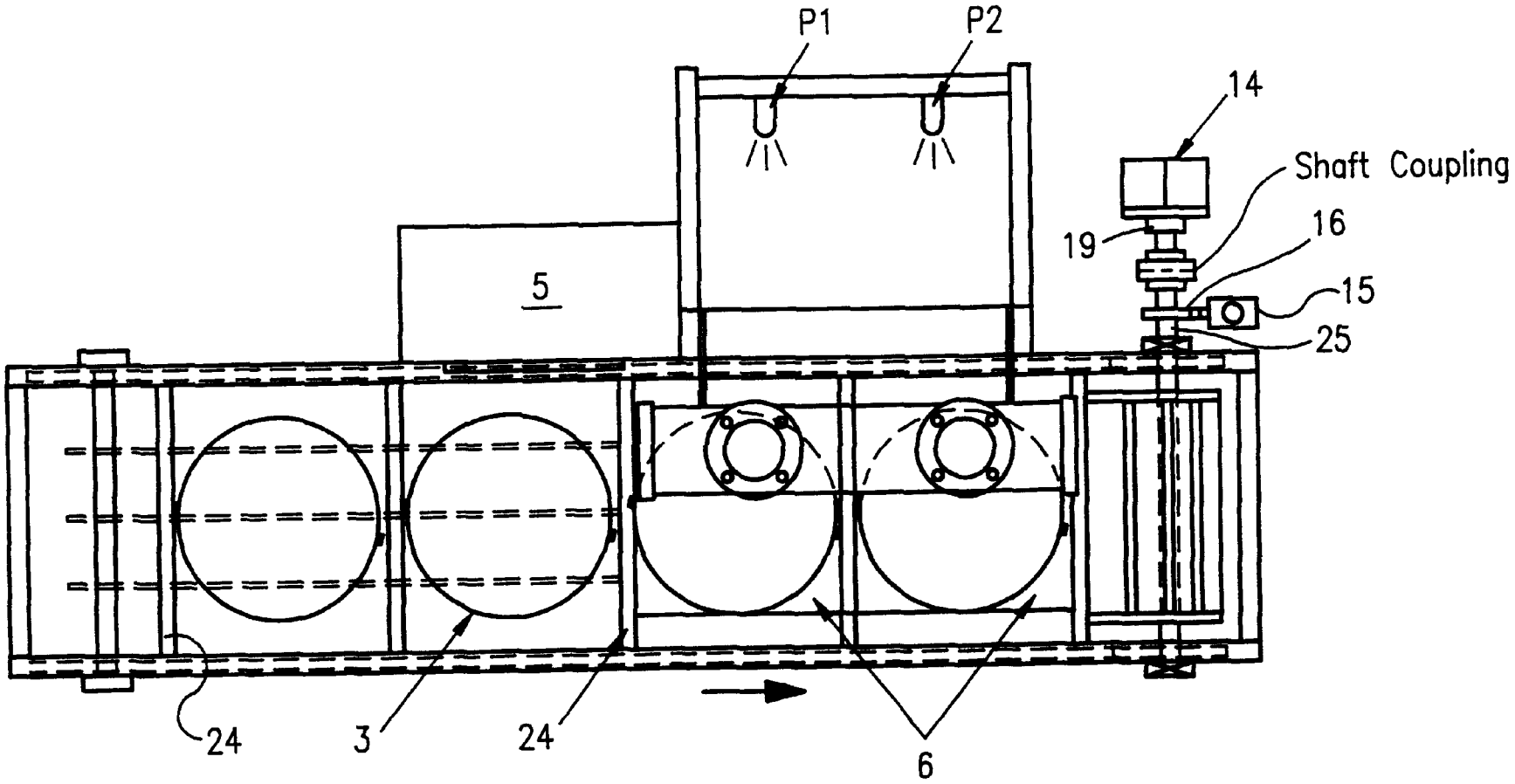
FIG. 3 is plan view of the system in diagrammatic form and with parts removed.

Referring to FIGS. 1 and 2, conveyor 2 is an endless conveyor including sprockets 22 mounted on drive shafts 25 at opposite ends of the conveyor where they are suitably mounted in the conveyor frame 7. Endless chains 23 are mounted about and driven by sprockets 22, there being a pair of sprockets 22 spaced laterally from each other at each end of the conveyer. Extending between the chains 23 are flight bars 24 which in the specific embodiment shown are spaced from each other fourteen and one eighth inches (14⅛") for receiving containers 3 between them. In the preferred embodiment where the containers being filled are five gallon containers, the conveyor is periodically advanced or indexed twenty eight and one quarter inches (28¼") so as to advance two empty containers to the filling station below the fill valves and to remove the previously filled containers away from the filling stations. Flight bars 24 of course engage the containers and periodically drive them over a suitable bed, shown as rolls 8, to and beyond the filling station.

In accordance with the present invention a novel drive and control system is used to periodically drive or index the conveyor 2 to the filling station. This system includes a fluid motor generally designated 14 preferably an air motor, and in the specific embodiment shown, two air motors 14*a* and 14*b* are employed for increased torque. Referring to FIG. 2, air motors 14*a* and 14*b* each include a piston 30 and a piston rod 29 having a gear rack 28 formed thereon for engagement with a pinion gear 26 mounted on a pinion shaft 27. In the specific embodiment shown, the conveyor drive shaft 25 is coupled by a coupling 21 to a shaft 25*a* which in turn is connected to the pinion shaft 27 by means of a one-way clutch mechanism for example a Torrington roller clutch 19 which permits shaft 25*a* and conveyor drive shaft 25 to be driven in only one direction by the pinion 26 and pinion shaft 27 so that the conveyor 2 can only be driven in one direction toward the filling station. Although air motors 14*a* and 14*b* are driven in opposite directions; only one direction serves to advance empty containers to the filling station while in the other direction, clutch mechanism 19 will not transmit drive from the pinion shaft 27 to the conveyor drive shaft so that the containers will remain at the filling station during a filling operation.

Figure 4:
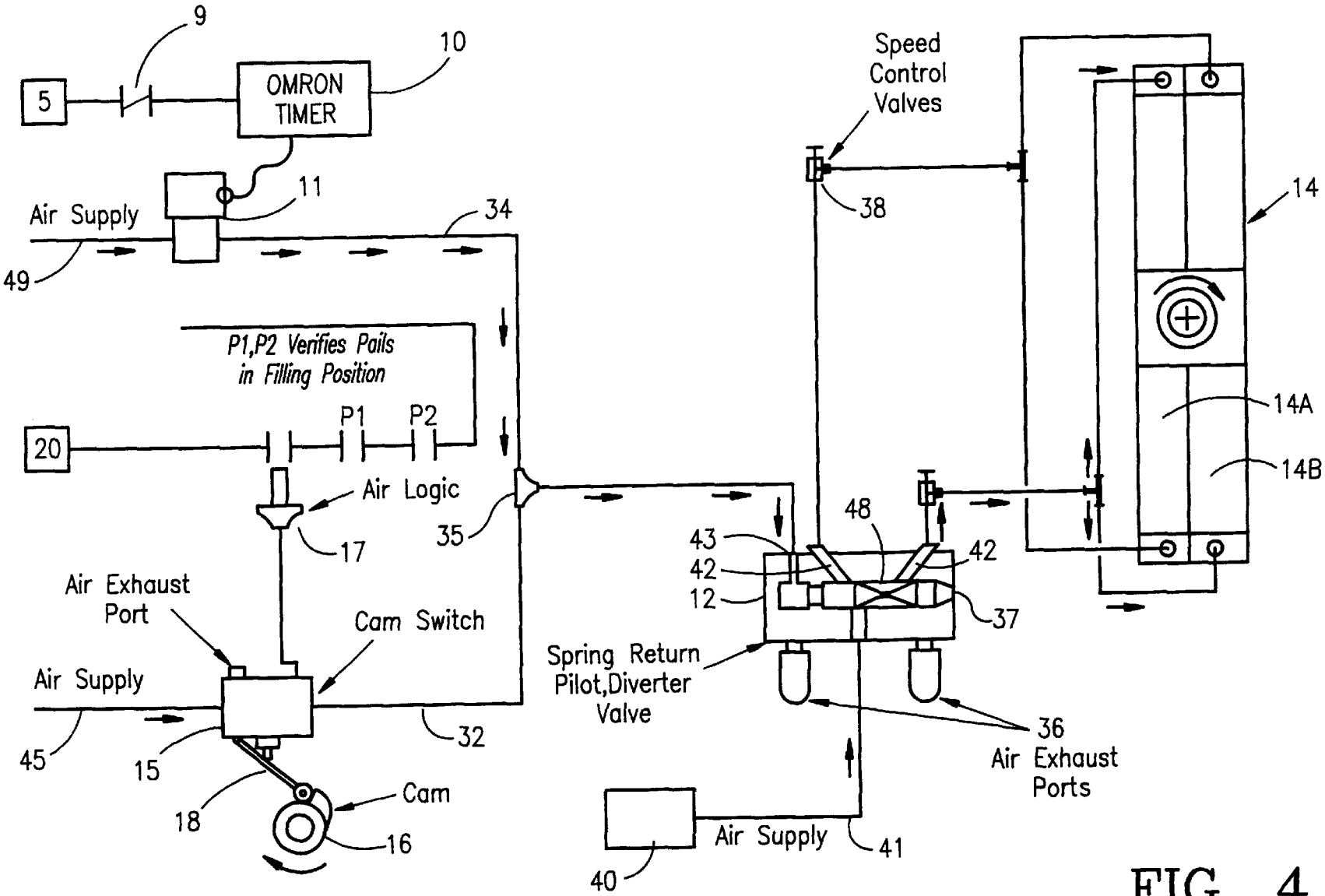
FIGS. 4, 5 and 6 are diagrammatic views of a drive and control circuit for operating the system respectively showing three successive modes of operation.

Referring now to FIG. 4 air motors 14A and 14B are supplied with air from a supply source 40 having an air supply line 41 leading to a control valve generally designated 12 such as a diverter valve including a spool 48 slidable in a passage to control air supply ports 42 and exhaust ports 36. A return spring 37 is also included in the spool passage to return the spool to a starting position for starting a new cycle as will be described in greater detail. The control valve 12 per se is of course well known. Air supply ports 42 communicate with air lines leading to opposite ends of the motors 14A and 14B. Preferably speed control valves 38 are placed in these air supply lines and may be adjusted to control the speed of operation of the air motors and in turn the conveyor drive shaft 25.

Figure 5:
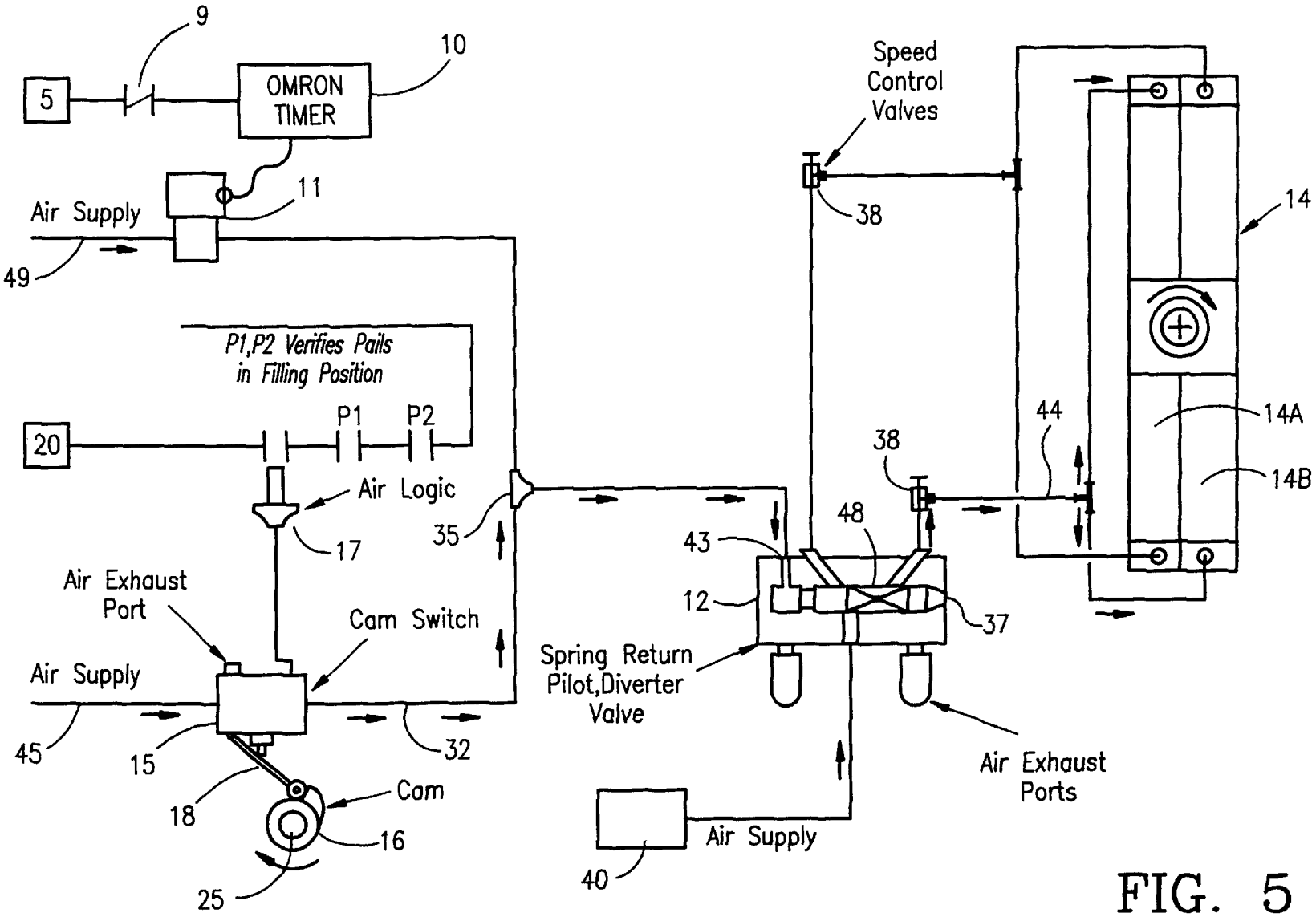

Referring to FIG. 4 during the cycle when fluid motor 14 is being operated for advancing the conveyor to carry containers to and away from the filling station, control valve spool 48 is positioned by air from an air supply line 32 which includes a shuttle valve 35 which directs the flow of air to an inlet port 43 in the control valve 12 for supplying air to drive the spool to the right as viewed in FIG. 4. In this position of the spool 48 spring 37 is of course compressed and air flows from air supply 40 around the spool and out one of the air supply ports 42 then through the speed control valve 38 and then through air supply line 44 from where it branches out to one end of air motor 14B and the opposite end of air motor 14A as shown by the arrows in FIG. 5. During this operating cycle, a cam generally designated 16 fixed to drive shaft 25 as shown in FIGS. 2 and 5 rotates clockwise as viewed in FIG. 5 until it engages a lever actuating arm 18 for actuating an air supply valve 15 to closed position which stops the flow of air from an air supply line 45 to air supply 32 which leads to the shuttle valve 35 as described above. This stops the flow of air through the inlet port 43 into the control valve 12 causing return spring 37 to move the control valve spool 48 to the left as viewed in FIG. 6 whereupon air supply from source 40 will enter control valve 12, pass about the reduced section of spool 48 and exit from the other air supply port 42A as shown in FIG. 6 and then passing through line 46, speed control valve 38 and then to the opposite ends of the air motors 14A and 14B to return them to starting position from which a new cycle of operation of the conveyor will begin.

Figure 6:
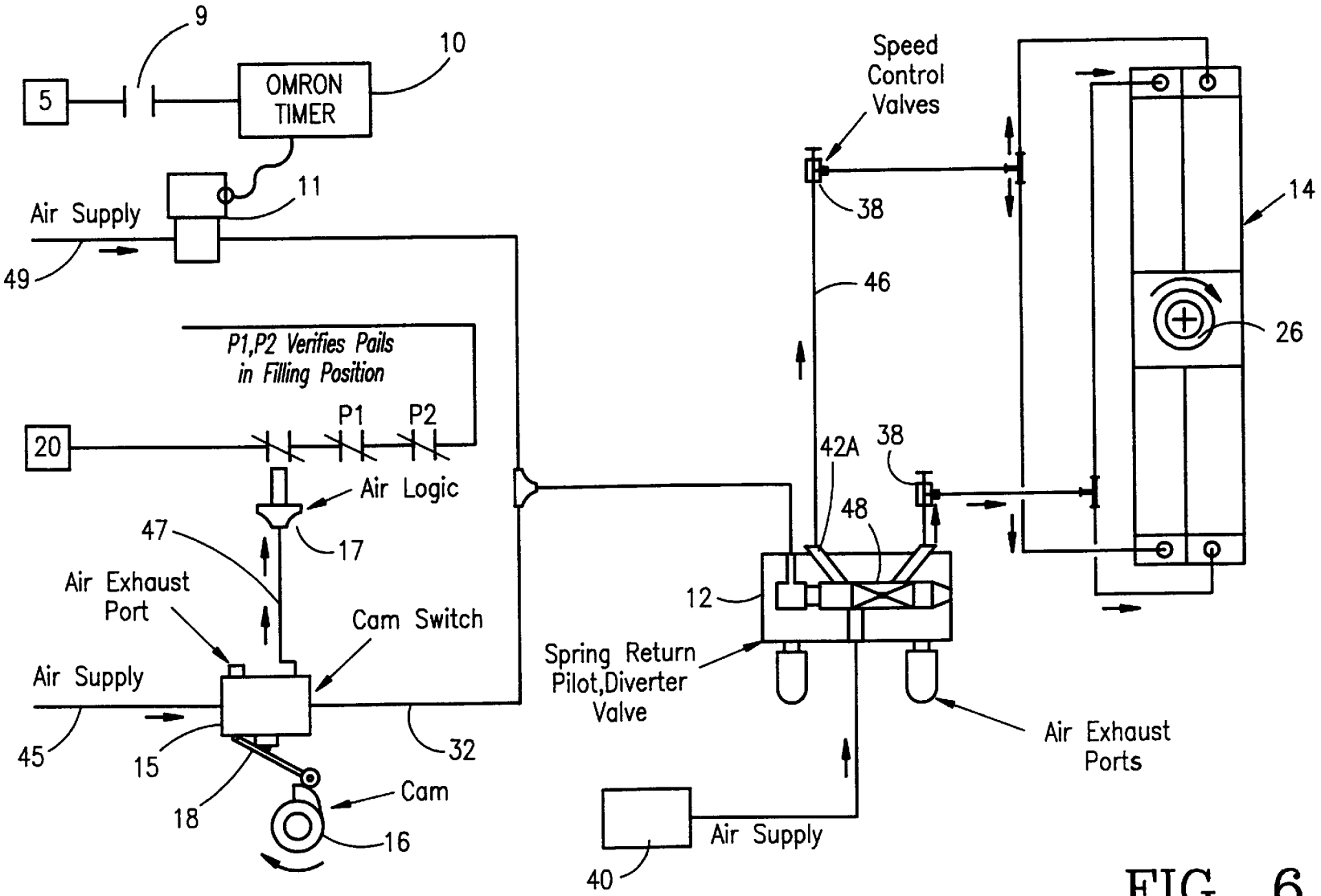

As indicated by the arrows in FIG. 6 when air supply line 32 is closed by valve 15 under the action of cam 16 and actuating arm 18, air from air supply line 45 will pass to air supply line 47 and to an air logic device 17 which will cause infra red relays P1 and P2 to close if two containers 3 are present at the filling station. Once relays P1 and P2 are closed, this will complete a circuit through a relay 20 causing the fill valves at 4 to open to commence filling of the containers 3. Referring to FIG. 4, when the containers 3 have been filled to the desired amount, computer 5 will send a signal through a timer 10 to open air supply valve 11 for allowing air from supply line 49 to pass through supply line 34, shuttle valve 35 and then into the inlet 43 of the control valve 12 to move the spool valve 48 to the right to commence operation of fluid motor 14. This will of course commence operation of conveyor and rotation of cam 16 which will move off the actuating lever arm 18 of air supply valve 15 thus allowing air to flow from line 45 to line 32 and into the control valve 12 (as shown in FIG. 5) to maintain the spool 48 in the desired position for supplying the fluid motor 14 with air for driving motor 14. Timer 10 is programmed so that it will remain in operation for opening the air supply valve 11 for only a short duration of time necessary to rotate cam 16 off the lever arm 18 at which time the timer will cause the air supply valve 49 to close. Once the target weight to be introduced into the containers 3 is selected at the panel of the computer 5 at the start of a production run, the filling operation from cycle to cycle is automatic and repeated as desired.

It will be seen from the above that the present invention obviates a disadvantage of prior art control and drive systems utilizing electric or other rotating motors with brake systems for starting and stopping the conveyor. Such systems produce excessive noise and require repeated maintenance including lubrication and repair.

Although the present invention has been shown and described in connection with a system for conveying and filling containers, it will be appreciated that the present invention may be employed in other environments. Moreover other variations and embodiments of the present inventions, though not specifically shown and described above, will still become readily apparent to those skilled in the art without departing from the present invention which is covered in the appended claims.

What is claimed is:

1. A conveyor system including in combination: a conveyor for transporting objects in one direction, a fluid motor for driving the conveyor in one direction, a first fluid supply line including a supply valve and a control valve for controlling the supply of fluid to said motor for driving said fluid motor in said one direction, a drive shaft operatively connected to said fluid motor for driving said conveyor in said direction, means including a cam driven by said drive shaft for closing said supply valve, and a second fluid supply line for controlling the supply of fluid to said motor at least until said cam opens said fluid supply valve whereupon supply of fluid to said motor is controlled by said first fluid supply line.

2. The system of claim 1 wherein said second fluid supply line includes a second air supply valve and means including a timer for operating said second air supply valve.

3. The system of claim 2 wherein said means last defined includes a circuit for operating said second air supply valve and wherein said timer controls said circuit.

4. The system of claim 3 wherein said last defined means includes a computer for controlling the timer.

5. The system of claim 4 including a shuttle valve between said first and second supply lines and said control valve.

6. The system of claim 5 wherein said fluid motor includes an air motor having a rack for driving a pinion operatively connected to said drive shaft of the conveyer.

7. The system of claim 1 including a shuttle valve between said first and second supply lines and said control valve.

8. The system of claim 1 wherein said fluid motor includes an air motor having a rack for driving a pinion operatively connected to said drive shaft of the conveyer.

9. The system of claim 7 wherein there is further included a clutch means between said pinion and said drive shaft for driving said drive shaft in only one direction.

10. A system for conveying articles to a processing station comprising in combination a conveyor for transporting articles to the processing station, a fluid motor for driving the conveyer to the processing station, said fluid motor including a rack and a pinion driven by the rack, a control system for controlling the fluid motor including a control valve means for supplying motive fluid to the fluid motor, and means for controlling the control valve including means responsive to the termination of a process performed at the processing station and means responsive to movement of the conveyor including a member movable by the conveyor.

11. The system defined in claim 10 wherein said means responsive to the termination of a process at the filling station initiates movement of the fluid motor for delivering new articles to the processing station and removing the previous articles from the processing station and wherein said means responsive to the movement of the conveyor stops movement of the conveyor when articles reach the processing station.

12. The system defined in claim 11 wherein said means responsive to movement of the conveyer includes a cam driven by the conveyer.

13. The system defined in claim 10 wherein said means responsive to movement of the conveyer includes a cam driven by the conveyor.

14. The system defined in claim 13 wherein said means responsive to termination of a process includes a timer.

15. The system defined in claim 11 wherein said means responsive to termination of a process includes a timer.

* * * * *